US005573415A

United States Patent [19]

Fujitani et al.

[11] Patent Number: 5,573,415

[45] Date of Patent: Nov. 12, 1996

[54] CARD EDGE CONNECTOR AND METHOD FOR CONNECTING SAME

[75] Inventors: Mitsuhiro Fujitani; Yasuo Matsushita, both of Yokkaichi, Japan

[73] Assignee: Sumitomo Wiring Systems, Ltd., Mie, Japan

[21] Appl. No.: 338,853

[22] Filed: Nov. 14, 1994

[30] Foreign Application Priority Data

Nov. 17, 1993 [JP] Japan ..... 5-312748

[51] Int. Cl.[6] ..... H01R 23/68

[52] U.S. Cl. ..... 439/260

[58] Field of Search ..... 439/260, 267

[56] References Cited

U.S. PATENT DOCUMENTS

| | | | |
|---|---|---|---|
| 4,148,537 | 4/1979 | Sochor . | |
| 4,300,810 | 11/1981 | Brown et al. . | |
| 4,343,523 | 8/1982 | Cairns et al. . | |
| 4,448,466 | 5/1984 | Porter | 439/260 |
| 4,533,189 | 8/1985 | Scoccia et al. . | |
| 5,489,216 | 2/1996 | Matsushita et al. | 439/260 |

FOREIGN PATENT DOCUMENTS

| | | | |
|---|---|---|---|
| 2310061 | 11/1976 | France . | |
| 639056 | 12/1978 | U.S.S.R. | 439/260 |

*Primary Examiner*—Gary P. Paumen
*Attorney, Agent, or Firm*—Oliff & Berridge

[57] ABSTRACT

A card edge connector includes inner housings that accommodate electrically conducting terminals. The inner housings are rotatably supported within a box-like outer housing. A rotatable range is regulated by projected portions of the respective housings being abutted against each other, so that an opening of the outer housing is kept open to allow an end portion of a printed board to be inserted. In addition, the terminals do not come in contact with each other, so that the circuit is kept from being shorted. When the insertion of the end portion into the outer housing is started, the upper inner housing rides over the end portion slightly. However, as the end portion is further inserted to the depth of the outer housing, introducing cams formed on a hood enclosing the end portion cause the upper inner housing to rotate with a slight insertion force, thereby causing the terminals to be urged into full engagement with the end portion of the printed board.

9 Claims, 3 Drawing Sheets

CARD EDGE CONNECTOR AND METHOD FOR CONNECTING SAME

BACKGROUND OF THE INVENTION

The invention relates to a card edge connector for electrically connecting tongue portions of a plurality of terminals to a connecting section having a plurality of stripped terminals formed on an edge portion on both surfaces of a printed board. The invention also relates to a method for connecting opposed terminals to a printed board.

A card edge connector is designed to connect an edge portion of a printed board between opposed terminals. A connecting section of the printed board has a plurality of terminals juxtaposed on both surfaces of the edge portion of the printed board. The terminals are formed by stripping parts of printed wire paths on the edge portion. A conventional card edge connector of this type is shown in FIGS. 6 and 7.

In FIGS. 6 and 7, terminals (not shown) are formed on both surfaces of an end portion of a printed board. A slit-like insertion opening 4, which allows the end portion 1 of the card to be inserted therein, is formed in a box-like housing 3 of a card edge connector 2. The housing 3 holds terminals 5, 5 formed on opposite sides of a slender space 7 that communicates the insertion opening 4 within the depth of the housing 3. The respective terminal fittings 5, 5 have flexible tongue-like abutment portions 6 that project toward each other in the slender space 7.

With this construction, to connect the card edge connector 2 to the end portion 1 of the printed board, the end portion 1 is aligned with the insertion opening 4 of the housing 3 and inserted or slid into the insertion opening 4 to an inserted position shown in FIG. 7. During insertion, the end portion 1 pushingly expands the opposed vertically projecting tongue-like abutment portions 6 away from each other as the end portion moves toward the space 7 along a longitudinal axis of the insertion opening 4.

In the aforementioned conventional card edge connector, the end portion 1 abuts against the abutment portions 6 obliquely to cause the abutment portions 6 to flex while sliding along the abutment portions 6 during insertion of the end portion 1. Accordingly, the end portion 1 is subjected to frictional and spring resistance at the time the end portion 1 pushingly expands the abutment portions 6. In some cases, the frictional resistance is of such a magnitude that the end portion 1 cannot slide well, thus deforming the abutment portions 6. In addition, the large frictional and spring resistance adversely affects the connecting operation.

SUMMARY OF THE INVENTION

The invention has been made in consideration of the aforementioned circumstances and an object of the invention is, therefore, to provide a card edge connector capable of being connected to a plate member such as a printed board with a small force.

Another object is to prevent reduction in operability, deformation of electrically conducting terminals, and the like.

According to a first aspect of the present invention, there is provided a card edge connector for holding a plurality of terminals and for connecting the terminals to upper and lower surfaces of a card edge. The card edge connector includes an inner housing for holding the terminals in opposed relation, an outer housing adapted to rotatably mount the inner housing, the outer housing having a card edge insertion opening sized for insertion of the card edge, and an outer housing opening sized for insertion of the inner housing. The outer housing opening is located on a side of the outer housing that is opposite to a side on which the card edge insertion opening is formed. In addition, the connector includes a rotation regulating mechanism for regulating a rotatable range of the inner housing so that rotation of the inner housing does not interfere with insertion of the card edge into the card edge insertion opening; and a rotating mechanism for rotating the inner housing so that the terminals of the inner housing abut against the upper and lower surfaces of the card edge terminals after the card edge is initially disposed between the terminals.

According to a second aspect of the present invention, there is provided a connector for connecting a plurality of opposed terminals to a printed board. The connector comprises a pair of opposed terminal housings adapted to house the plurality of opposed terminals; and means for moving the pair of terminal housings toward each other and toward the printed board after the printed board has been inserted between the opposed terminal housings to a substantially completely fitted position.

According to a third aspect of the present invention, there is provided a connector for connecting a plurality of opposed terminals to upper and lower surfaces of a printed board. The connector includes an outer housing having a front wall formed with an insertion opening and side walls each formed with a pair of bearing members; an inner housing fittable within the outer housing, the inner housing including a pair of sub-inner housing members rotatively mounted with respect to each other on the pair of bearing members on opposite sides of said insertion opening, the sub-inner housing members being arranged to accommodate said plurality of opposed terminals; and means for maintaining a space between the printed board and at least one of the sub-inner housing members, including its associated terminals, when the printed board is initially inserted into the insertion opening.

According to a fourth aspect of the present invention, there is provided a method for sandwiching a printed board between a plurality of opposed terminals. The method includes providing an outer housing with an insertion opening adapted to receive the printed board; disposing a pair of terminal housing members within the outer housing, each of the terminal housing members being mounted on said outer housing on opposite sides of said insertion opening; inserting the printed board into the insertion hole while maintaining a space between the terminal housing members during initial insertion of the printed board; and moving the terminal housing members toward the insertion opening, thereby closing said space, when the printed board approaches a completely inserted position, thereby firmly sandwiching the printed board between the terminal housing members.

According to a fifth aspect of the present invention, there is provided a method of connecting a plurality of opposed terminals to a printed board. The method includes inserting the printed board between the opposed terminals; moving the opposed terminals toward each other and toward the printed board; and firmly clamping the printed board between the terminals.

The rotation regulating mechanism may have projected portions formed on inner walls of the outer housing so as to confront the inner housing. Furthermore, the rotation regulating mechanism may have inner projected portions formed on outer walls of the inner housing so as to engage the outer housing.

In the first aspect of the invention, the inner housing may hold the abutment portions of electrically conducting terminals with the abutment portions projecting from a surface thereof, and the projected surfaces of the abutment portions are rotatably accommodated in the outer housing so as to face in a radial direction. The outer housing includes an insertion opening that allows insertion of the edge portion of the card edge. Because the rotation regulating mechanism is provided to regulate the rotatable range of the inner housing with respect to the outer housing, insertion of the edge portion of the card into the card edge insertion opening of the outer housing cannot be blocked by the inner housing. Further, while the rotating mechanism causes the inner housing to rotate after the edge portion of the plate member is being initially inserted into the outer housing, the projected surfaces of the abutment portions of the terminals in the inner housing are rotated so as to face the radial direction, which causes the abutment portions of the electrically conducting terminals in the inner housing to be abutted against the terminals formed on the surface of the edge portion of the plate member while the terminals approach the card edge. Moreover, rather than sliding along the exposed card edge terminals during insertion, the terminals of the inner housings engage the card edge near the completion of the insertion operation with the direction of approach of the inner housing terminals being substantially perpendicular to the surfaces of the exposed card terminals.

Further, the projected portions may be formed so as to extend from the inner walls of the outer housing toward the inner housing, so that the projected portions regulate the rotatable range of the inner housing, which in turn contributes to maintaining the inner housing from blocking the insertion of the edge portion of the plate member into the insertion opening of the outer housing.

Still further, the projected portions may be formed so as to be projected from the outer walls of the inner housing, so that the projected portions regulate the rotatable range of the inner housing while the inner housing abuts against the inner walls of the outer housing, the outer housing projected portions, and an additional inner housing. This also contributes to maintaining the inner housing from disturbing or blocking the insertion of the edge portion of the plate member into the insertion opening of the outer housing.

As described in the foregoing, the invention has the effect of causing the inner housing, which is rotatably held within the outer housing, to hold the electrically conducting terminals, and allows the electrically conducting terminals to abut against the terminals on the edge portion of the card member as a result of the rotation or movement of the inner housing toward the printed board. Therefore, the edge portion of the card or plate member is no longer forced onto the abutment portions of the electrically conducting terminals, thereby preventing breakage and deformation of the electrically conducting terminals as well as implementing connection with a small force.

In addition, when the inner housing is freely movable within the outer housing, the edge portion of the plate member entering from the insertion portion of the outer housing sometimes collides against the inner housing. While a spring may be provided to prevent this from happening, a technique employed by the invention to prevent blocking of the insertion of the edge portion of the plate member is to provide a regulator for restricting the rotation or movement range of the inner housing. This aspect of the invention is advantageous in that the inner housing is not required to be rotated against the force of the spring when the edge portion of the plate member is inserted, thereby allowing the abutment portions to be connected to the edge portion of the plate member using a small force.

Moreover, the recessed and projected portions integrally formed with the outer housing and the inner housing regulate the rotatable range of the inner housing. Therefore, operation reliability is increased by maintaining the number of parts to a minimum.

These and other aspects and advantages of the present invention are described in or apparent from the following detailed description of preferred embodiments.

BRIEF DESCRIPTION OF THE DRAWINGS

The present invention will be described in detail with reference to the drawings, wherein.

DETAILED DESCRIPTION OF PREFERRED EMBODIMENTS

Figure 1:
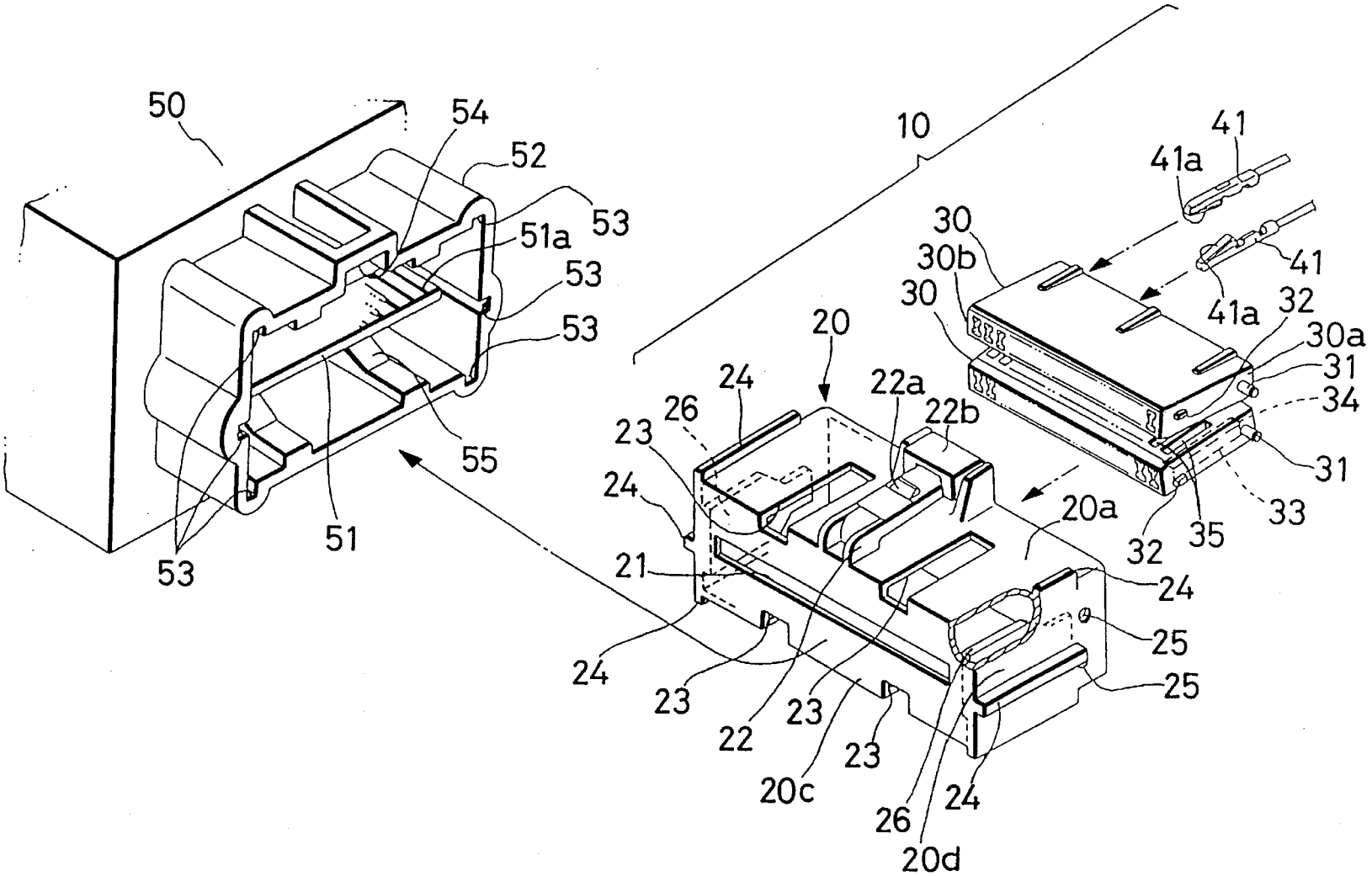
FIG. 1 is an exploded perspective view of a card edge connector.

FIG. 1 is an exploded perspective view of a card edge connector. In FIG. 1, a card edge connector 10 rotatably holds two flat box-like inner housings 30 inside a box-like outer housing 20. The outer housing 20 has an open rear surface and front side insertion opening 21. The insertion opening 21 is a horizontally extending slit-like opening. In a central portion on the upper wall of the outer housing 20, an axially extending lock arm 22 that is flexible in the vertical direction is provided. An upwardly projecting lock pawl **22*a* is formed in a central portion of the lock arm 22 and an operation knob 22*b*** is also formed at the lock arm's rear end.

A pair of notches 23 are formed on each of the upper and lower walls **20*a*, 20*b* at positions on each side of the lock arm 22 so as to be continuous to the front wall 20*c* of the lock arm 22. The pair of notches 23 communicate the inside of the outer housing 20 with the outside of the outer housing 20. Further, axially extending ribs 24 project vertically as well as outwardly from an end of each of the upper and lower walls 20*a*, 20*b* and from a middle portion of each lateral wall 20*d*. Bearing holes 25 are formed in two stages, upper and lower, in a portion closer to the rear end of each lateral wall 20*d*. An outer projected portion 26 is formed in relief at the middle position on the inner surface of each lateral wall 20*d* of the outer housing 20. Each outer projected portion 26** is formed such that the width of the rear end side is narrower than the width of the front end side.

Each inner housing 30 has a width enabling it to be inserted into the outer housing 20. Cylindrical rotating shafts 31 can be journaled while being inserted into the bearing holes 25 and project from the rear sides of both lateral surfaces 30*a*, 30*b* of the inner housing 30. In addition, flat plate-like inner projected portions 32 project outwardly from the frontward ends of the lateral surfaces 30*a*, 30*b* on which the rotating shafts 31 are formed. The inner projected portions 32 abut directly against the inner lateral surfaces of lateral wall 20*d* of the outer housing 20. Because the outer projected portions 26 are formed in relief on the inner lateral surfaces of the outer housing 20 so as to leave spaces between projected portions 26 and upper and lower walls 20*a*, 20*b*, the inner projected portions 32 can move without abutting against the corresponding outer projected portions 26.

Each inner housing 30 has horizontally juxtaposed terminal accommodating chambers 33 that can accommodate terminal fittings 41 with insertion openings 34 of the terminal fittings 41 opened on the rear side of the housing 30. In addition, each terminal fitting 41 has a vertically projected tongue-like abutment portion 41*a*. Communication openings 35 communicating with the terminal accommodating chambers 33 respectively are arranged on a surface of each inner housing 30 so that the abutment portions 41*a* can project from the inner housing 30 through the communication openings 35.

An end portion 51 of a printed board projects from an electronic circuit chassis 50. In addition, a cylindrical hood 52 projects from the chassis and is formed to enclose the end portion 51. The inner circumferential surface of the hood 52 is formed to correspond to the outer profile of the outer housing 20. The inner surface of the hood includes grooves 53 that mate with respective ribs 24 of the outer housing 20, and a groove-like arm insertion portion 54 that mates and cooperates with the lock arm 22 of the outer housing 20. The arm insertion portion 54 projects upwardly. In addition, introducing cams or guide surfaces 55 are formed so as to project on the inner surface sides of the hood 52. The introducing cams 55 correspond to the notches 23 formed in both the upper and lower walls of the outer housing 20. Each introducing cam 55 is formed such that its height increases when moving toward the chassis 50. Although surfaces of the introducing cams 55 serving as sliding surfaces are shown as being flat, such surfaces may be made semicircular in section in order to reduce friction at the time of sliding. Moreover, terminals 51*a*, which are formed by stripping the ends of printed wire paths, are provided on both surfaces of the end portion 51 of the printed board so as to correspond to the communication openings 35 of the inner housings 30.

The operation of the thus constructed embodiment will now be described. The terminal fittings 41 are inserted into the terminal accommodating chambers 33 of the inner housings 30 through the insertion openings 34 before assembling the card edge connector 10. At the time of insertion, the abutment portions 41*a* are inserted into the inner peripheral wall of the accommodating chambers 33 on which the communication openings 35 are formed, so that when the terminal fittings 41 are pushed in, the abutment portions 41*a* project from the communication openings 35. However, the terminal fittings 41 may be inserted after the card edge connector 10 has been assembled.

Then, the respective inner housings 30 are inserted into the opening on the rear side of the outer housing 20. The upper inner housing 30 is inserted with the communication openings 35 facing downward, so that the inner projected portions 32 stay above the outer projected portions 26 formed on the inner surfaces of the lateral walls 20*d* of the outer housing 20. Likewise, the lower inner housing 30 is inserted with the communication openings 35 facing upward, so that the inner projected portions 32 stay below the outer projected portions 26 formed on the inner surfaces of the lateral walls 20*d* of the outer housing 20. The outer housing 20 is thereafter flexed to pushingly expand the opening on the rear side in the horizontal direction to allow the rotating shafts 31 to pass through the bearing holes 25, thus completing the connection between the inner housing 30 and the outer housing 20.

Figure 2:
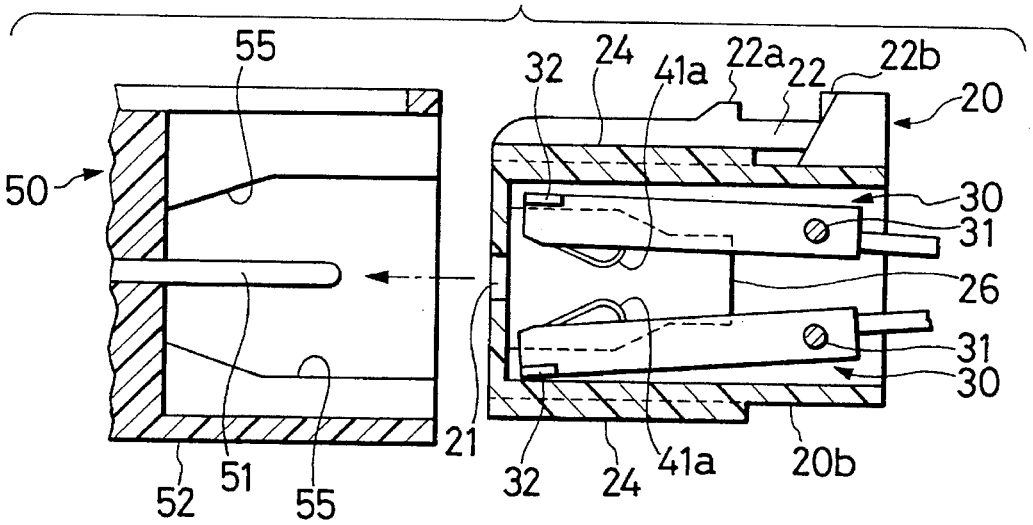
FIG. 2 is a sectional view showing a first stage of the process of connecting the card edge connector.

As shown in FIG. 2, the lower inner housing 30 contacts the upper surface of the bottom wall 20*b* of the outer housing 20 and is, therefore, remotely located from the slit-like opening 21. However, in the upper inner housing 30, the inner projected portions 32 formed on the lateral surfaces 30*a*, 30*b* contact the upper portions of the outer projected portions 26 and are, therefore, located closer to the slit-like opening 21 within the rotatable range than the projected portion 32 on the lower inner housing. That is, the abutment of the inner projected portions 32 against the outer projected portions 26 allows the rotatable range of the upper inner housing 30 to be regulated, thus inhibiting the upper inner housing 30 from rotating toward the opening 21, although the upper inner housing 30 is located closest to the opening 21. This condition keeps the terminals 41*a* from contacting each other, thus preventing short-circuiting.

Figure 5:
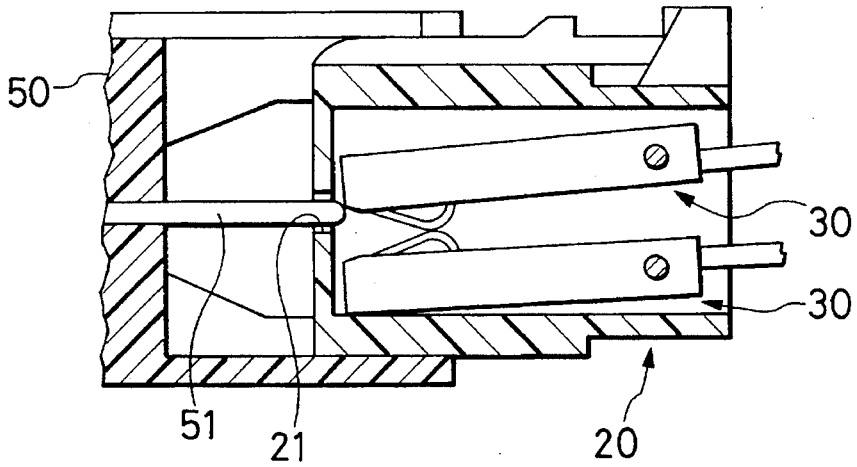
FIG. 5 is a sectional view showing the process of connecting the card edge connector in the case where no rotation regulating mechanism is provided.
Figure 6:
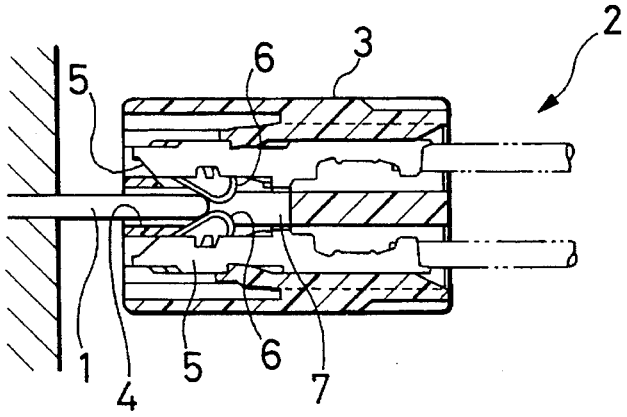
FIG. 6 PRIOR ART
FIG. 6 is a sectional view showing the process of connecting a conventional card edge connector.
Figure 7:
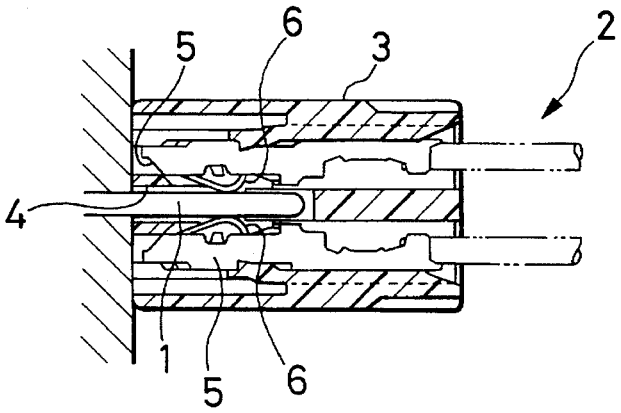
FIG. 7 PRIOR ART
FIG. 7 is a sectional view showing the process of connecting the conventional card edge connector.

Without such regulation, the upper inner housing 30 moves or rotates toward the lower inner housing 30, not only slightly closing the opening 21, but also causing short-circuiting between the terminals 41*a* of the upper and lower inner housings (see FIG. 5). As a result, when inserting the end portion 51 of the printed board, the end portion 51 can undesirably abut against the front end of the upper inner housing 30, thus blocking insertion of the end portion.

With the card edge connector 10 of the present invention, the card edge connector 10 is inserted into the hood 52, which projects from the electronic circuit chassis 50, as shown in FIG. 2. As the card edge connector 10 is inserted from the front wall thereof with the respective ribs 24 of the outer housing 20 aligned with the grooves 53 of the hood 52, the introducing cams 55 are inserted into the notches 23 of the outer housing 20. However, because the height of the introducing cams 55 is small, the introducing cams 55 serve to position the outer housing 20 but do not allow themselves to be positively inserted into the outer housing 20. Both inner housings 30 are located at least at such positions as to prevent closing the opening 21, so that a gap is created or provided between the inner housings 30. Therefore, as the end portion 51 of the printed board initially enters the outer housing 20 through the insertion opening 21, the upper inner housing 30 rotates with the abutment portions 41*a* only slightly contacting the end portion 51, which causes the upper inner housing 30 to directly ride over the end portion 51. The lower inner housing 30 and the abutment portions 41*a* of the lower inner housing, however, only slightly contact with or nearly contact the end portion 51, which reduces the force required to push the end portion 51 during initial insertion.

Figure 3:
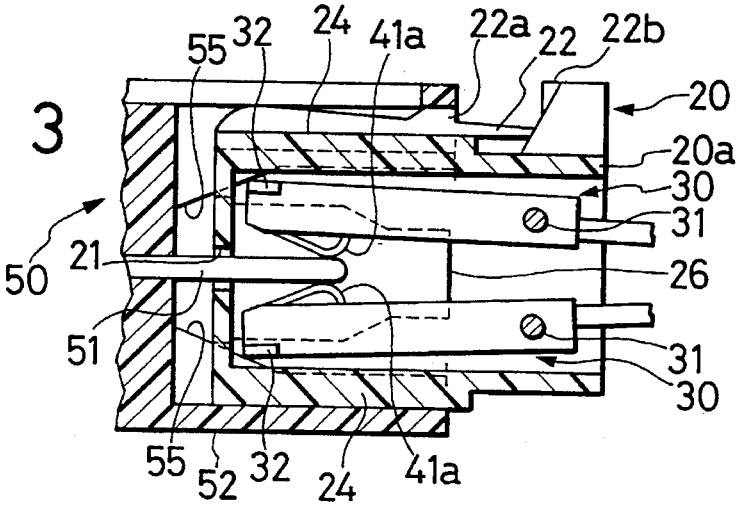
FIG. 3 is a sectional view showing the second stage of the process of connecting the card edge connector.

However, as the inner and outer housing assembly is further inserted toward the chassis to engage the highly projected portions of the introducing cams 55 with notches 23 as shown in FIG. 3, the front end corner portions of the inner housings 30 abut against the slopes of the introducing cams 55. The introducing cams 55 formed on the upper and lower inner surfaces of the hood 52 increase in height or thickness when moving toward the chassis 50. Therefore, when the front end corner portions of the inner housings 30 are pushed into the hood 52 while abutted against the slopes of the introducing cams 55, both inner housings 30 are urged closer to each other toward the center. That is, the rotating mechanism allows the inner housings 30 to rotate when the front end corner portions of the inner housings 30 abut against the slopes of the introducing cams 55.

As both inner housings 30 move closer toward each other, the abutment portions 41*a* of the terminal fittings 41, which project through the communication openings 35, are strongly urged into engagement with the terminals 51*a* formed on the surfaces of the end portion 51 of the printed board. Because the inner housings 30 receive the end portion 51 of the printed board, and then pivot about the rotating shafts 31, the terminal fittings 41 are urged onto the end portion 51 generally at an angle close to right angles. When the terminal fittings 41 engage the end portion 51 in this way, the abutment portions 41*a* are held down without undue deformation or the like.

Figure 4:
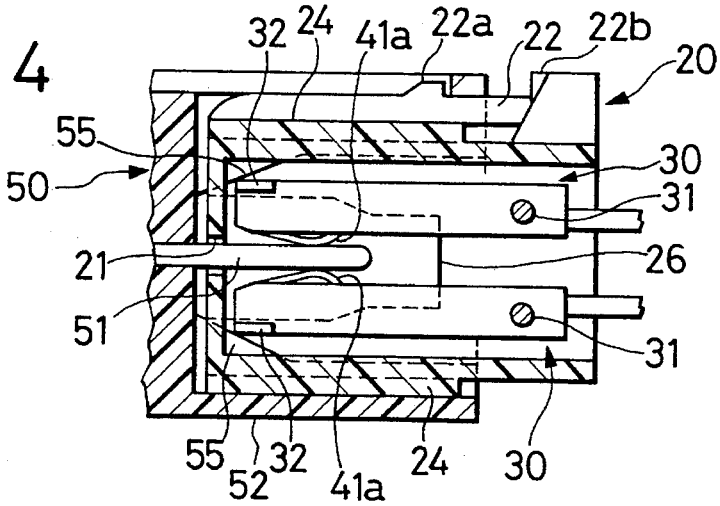
FIG. 4 is a sectional view showing the final condition of the process of connecting the card edge connector.

When the outer housing 20 has been completely inserted to the hood 52, both inner housings 30 confront each other generally in parallel with each other, thus being connected to the terminals 51*a* with the abutment portions 41*a* sandwiching the end portion 51 of the printed board as shown in FIG. 4.

As described in the foregoing, although the inner housings 30 that accommodate the electrically conducting terminals 41 therein are rotatably supported within the box-like outer housing 20, the rotatable range thereof is regulated by the projected portions 32, 26 of the respective housings 30, 20 being abutted against each other. Accordingly, the opening of the outer housing 20 is maintained or kept open to allow the end portion 51 of the printed board to be inserted thereinto. In addition, the terminals 41*a* do not come in contact with each other, so that the circuit is prevented from short-circuiting. When the insertion of the end portion 51 into the outer housing 20 is initially started, the upper inner housing 30 gently rides over the end portion 51. As the end portion 51 is further inserted, the introducing cams 55 formed on the hood 52 enclosing the end portion 51 cause the upper inner housing 30 to rotate with a slight insertion force, thereby causing the abutment portions 41*a* to be urged onto and connected to the terminals 51*a*.

The invention has been described in detail with reference to preferred embodiments thereof, which are intended to be illustrative and not limiting. Various modifications may be made without departing from the spirit and scope of the invention as defined in the appended claims.

What is claimed is:

1. A card edge connector for holding a plurality of terminals, and for connecting the terminals to upper and lower surfaces of a card edge, the card edge connector comprising:

a pair of inner housings for holding the terminals in opposed relation;

an outer housing adapted to rotatably mount the inner housings, said outer housing having a card edge insertion opening sized for insertion of the card edge, and an outer housing opening sized for insertion of the inner housings, said outer housing opening being located on a side formed on the outer housing that is opposite to a side on which the card edge insertion opening is formed;

a rotation regulating mechanism for regulating a rotatable range of the inner housings so that the inner housings do not interfere with said insertion of the card edge into the card edge insertion opening of the outer housing, the rotation regulating mechanism including projected portions formed on one of inner walls of the outer housing that engage the inner housings and outer walls of the inner housings that engage the outer housing; and a rotating mechanism for rotating the inner housings so that the terminals of the inner housings abut against the upper and lower surfaces of the card edge terminals after the card edge has been initially inserted between the terminals.

2. A connector for connecting a plurality of opposed terminals to a printed board, comprising:

a pair of opposed terminal housings adapted to house said plurality of opposed terminals;

means for moving the pair of terminal housings toward each other and toward the printed board after the printed board has been initially inserted between the opposed terminal housings to a substantially completely fitted position, wherein the means for moving includes cam-like guide portions mounted on a hood surrounding the printed board, said hood and said printed board being mounted on a common chassis, said cam-like guide portions cooperating with notches formed on an outer housing such that the cam-like guide portions extend through said notches to move ends of said opposed terminal housings toward the insertion opening when the printed board is positioned adjacent said chassis; and means for restricting movement of the opposed terminal housings, said means for restricting movement including protrusions formed on inner surfaces of said side walls of an outer housing that houses said opposed terminal housings, and a follower formed on outer surfaces of each side of said opposed terminal housings.

3. A connector for connecting a plurality of opposed terminals to upper and lower surfaces of a printed board, said connector comprising:

an outer housing having a front wall formed with an insertion opening and side walls each formed with a pair of bearing members;

an inner housing fittable within the outer housing, said inner housing including a pair of sub-inner housing members that are mounted with respect to each other on said pair of bearing members on opposite sides of said insertion opening, said sub-inner housing members being arranged to accommodate said plurality of opposed terminals; and means for maintaining a space between the printed board and at least one of the sub-inner housing members, including its associated terminals, when the printed board is initially inserted into said insertion opening, wherein the means for maintaining further comprises means for restricting rotary movement of the sub-inner housing members such that the opposed terminals do not short circuit, said means for restricting including protrusions formed on inner surfaces of said side walls of said outer housing, and a follower formed on outer surfaces of each side of said sub-inner housing members.

4. The connector of claim 3, further comprising means for moving said sub-inner housing members toward said insertion opening when the printed board approaches a completely inserted position within said insertion opening.

5. The connector of claim 4, wherein the means for moving includes cam-like guide portions mounted on a hood surrounding the printed board, said hood and said printed board being mounted on a common chassis, said cam-like guide portions cooperating with notches formed in said outer housing such that the cam-like guide portions extend through said notches to rotate ends of said sub-inner housing members toward the insertion opening when the printed board is positioned adjacent said chassis.

6. The connector of claim 3, wherein said sub-inner housing members include shafts that cooperate with respective ones of said pair of bearing members formed on the outer housing.

7. A method for sandwiching a printed board between a plurality of opposed terminals, said method comprising:

providing an outer housing with an insertion opening adapted to receive said printed board;

disposing a pair of terminal housing members within said outer housing, each of said terminal housing members including an outer surface that engages an inner surface of the outer housing and being mounted on said outer housing on opposite sides of said insertion opening;

inserting said printed board into said insertion hole while maintaining engagement between said inner and outer surfaces, thereby regulating a space between said terminal housing members during initial insertion of the printed board; and moving the terminal housing members toward the insertion opening along a path defined by the engagement between the inner and outer surfaces, thereby closing said space, when the printed board approaches a completely inserted position, thereby firmly sandwiching the printed board between the terminal housing members.

8. The method of claim 7, further comprising providing guides adjacent said printed board, wherein said moving step includes rotating the terminal housing members toward said insertion opening with said guides when the printed board approaches said completely inserted position.

9. The method of claim 7, further comprising restricting movement of said terminal housing members during said initial insertion.

* * * * *